US006609920B2

(12) United States Patent
Koyasu

(10) Patent No.: US 6,609,920 B2
(45) Date of Patent: Aug. 26, 2003

(54) CONNECTOR STRUCTURE OF MOTOR VEHICLE DOOR

(75) Inventor: Ryo Koyasu, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/131,484

(22) Filed: Apr. 25, 2002

(65) Prior Publication Data

US 2002/0173189 A1 Nov. 21, 2002

(30) Foreign Application Priority Data

May 16, 2001 (JP) ..... 2001-146427

(51) Int. Cl.[7] ..... H01R 29/00
(52) U.S. Cl. ..... 439/188; 439/34
(58) Field of Search ..... 439/34, 188, 489; 200/51.1, 51.12, 51.09, 51 R

(56) References Cited

U.S. PATENT DOCUMENTS 5,788,520 A * 8/1998 Roche ..... 439/188
5,791,922 A * 8/1998 Takata et al. ..... 439/188
5,944,547 A * 8/1999 Golab et al. ..... 439/188
6,036,515 A * 3/2000 Nakamura ..... 439/188
6,171,124 B1 * 1/2001 Kojima ..... 439/188
6,332,781 B1 12/2001 Ito

FOREIGN PATENT DOCUMENTS

JP 2000-62546 2/2000

* cited by examiner

*Primary Examiner*—Gary Paumen
(74) *Attorney, Agent, or Firm*—Armstrong, Westerman & Hattori, LLP

(57) ABSTRACT

A connector structure of a motor vehicle door is provided, by which a space for mounting electric components can be secured in a vehicle body and the cost of the electric component can be reduced by making the connector have multifunction. The connector structure includes a first female terminal forming a break contact provided in one connector selected between a first connector at a vehicle body-side and a second connector at a door-side; and an insulating member provided in the other connector, so that the insulating member is inserted into the first female terminal when the first and second connectors engage with each other, thereby an electric circuit can be cut. A second female terminal forming a make contact is provided next to the first female terminal and a male terminal forming a break terminal coming in contact with the second female terminal is provided next to the insulating member.

6 Claims, 5 Drawing Sheets

CONNECTOR STRUCTURE OF MOTOR VEHICLE DOOR

BACKGROUND OF THE INVENTION (1) Field of the Invention

The present invention relates to a connector structure of a motor vehicle door, which is applied to a rear door or sliding door of a motor vehicle.

(2) Description of the Related Art

Various auxiliary machines or electric components such as a rear wiper, door lock, tail lamp, defroster, back monitor and power window are mounted in a motor vehicle door such as a rear door or sliding door. Various connector structures, each of which supplies an electric power of the vehicle body-side, have been proposed.

FIG. 5 illustrates a connector structure of a motor vehicle door described in Japanese Patent Application Laid-Open No. 2000-62546 proposed by the present applicant as an example of the prior art in connection with this kind of connector structure of a motor vehicle door.

A vehicle body-side connector 53 includes a housing 71 made of insulating (electrically insulating) resin and a plurality of female terminals 65 received in the housing 71 in parallel closely to each other. The housing 71 consists of an upper cover (not shown) and a lower cover (not shown).

The housing 71 has openings 77 situated in parallel to each other for receiving a male terminal 55. Each female terminal 65 is received in a corresponding opening 77. The opening 77 is closed by a shutter 75 made of synthetic resin mounted to an end of the female terminal 65. The housing 71 is fixed to a vehicle body by an inclined-shape flange (not shown).

The female terminal 65 is inserted over a cylinder shaft (support shaft) 76 made of metal with being opened and closed, and biased to the closing direction by a twisted coil spring (spring member) 72 around the cylinder shaft 76. The twisted coil spring 72 consists of a coil roll 73 and a leg 74 extending backward long from the coil roll 73.

Each contact member 63 of the female terminal 65 includes a flat plate-shaped hinge 64, a side plate (a part to receive a bias) 66 rising perpendicularly from the hinge 64, an inclined part 67 being inclined forward from the side plate 66, and a contact 68 continuing to the inclined part 67.

A pair of the hinges 64 is piled up each other and pressed onto an electrode (not shown) at the housing 71-side by the coil roll 73 of the twisted coil spring 72. The twisted coil spring 72 biases the contact 68 and biases the hinge 64 with respect to the electrode simultaneously. The electrode is connected to a power supply wire (not shown) through a terminal in a female connector (not shown) for connecting the power supply.

A shutter 75 is fixed to an end of each female terminal 65 and opens or closes together with the contact 68. The shutter 75 includes an end surface 75*a* having narrow width, a guide surface 75*b* inclining inward with a tapered-shape from the end surface 75*a*, and closing surface 75*c* adhering at the inside end of the guide surface 75*b*. A pair of the closing surfaces 75*c* comes in close contact with each other when both contacts 68 come in contact with each other, thereby a water drop or a dust is prevented from entering into the contact 68 from the opening 77 of the housing 71.

A connector 52 at the door-side includes a housing 58 made of insulating resin, a male terminal 55 biased by a spring in the protruding direction in the housing 58, and a cushion 61 made of rubber for the connector at the vehicle-body side, which is arranged outside the electric contact 54 of the male terminal 55.

A projection (not shown) for receiving a spring and a notch (not shown) for inserting the spring are formed at a base end-side of the electric contact 54 of the male terminal 55. A compression coil spring 60 is provided between the projection for receiving the spring at the base end-side of the electric contact 54 and a projection 59 for receiving a spring of the cover 56. The strength of the compression coil spring 60 is set larger than the insertion force of the electric contact 54 against the female terminal 65. The electric contact 54 retreats inward with compressing the compression coil spring 60 in the event that the electric contact 54 receives an accidental external force.

FIG. 6 is a circuit view illustrating the engaging state of the connector. The vehicle body-side has a battery (not shown) for supplying the power. The battery supplies the power to various electric components. Switches S1, S2 and electromagnetic relays R1, R2 are provided between the battery and the various electric components, thereby the on/off operation for the various electric components is carried out.

The switches S1, S2 are a lock-up switch, in which the state of the contact is maintained once the operation is done as long as the inverse operation is not done. The switch S1 is a switch for a defroster while the switch S2 is a switch for a courtesy lamp cooperating with the open/close action of the motor vehicle door. The courtesy lamp (not shown) turns on when the motor vehicle door is open while it turns off when the door is close.

As for the electromagnetic relays R1 and R2, each of them includes an electromagnetic coil rc1 or rc2 and a contact rs1 or rs2, respectively. The contact rs1 is a make contact (a contact to be closed upon excitation of the electromagnetic coil rc1) while the contact rs2 is a break contact (a contact to be opened upon excitation of the electromagnetic coil rc2).

However, as for the conventional connector structure of a motor vehicle door as described above, there are problems as mentioned below.

One problem is that a space for mounting the electric components cannot be secured when many switches and so on are mounted in a vehicle body space. That is, in a background that the number of the electric components to be mounted in a rear door or sliding door of a one-box car or station wagon tends to increase, if the number of the switches S1 and S2 increases, a space for mounting the electric components cannot be secured, resulting in that not only the electric components cannot be mounted but also there is a possibility that the interference among the components or the entanglement of the electric wires take place.

Another problem is that the cost of the component inevitably raises if the number of the switches S1 and S2 increases in a ground that the number of the electric components to be mounted on the vehicle body increases.

SUMMARY OF THE INVENTION

It is therefore an objective of the present invention to solve the above problems and to provide a connector structure of a motor vehicle door, by which a space for mounting electric components and so on can be secured in a space in a vehicle body and the cost of the electric component can be reduced by making a connector have multifunction.

In order to attain the above objective, the present invention is to provide a connector structure of a motor vehicle door comprising:

a first female terminal forming a break contact, which is provided in one connector selected between a first connector at a vehicle body-side and a second connector at a door-side; and an insulating member, which is provided in the other connector selected between the first connector at the vehicle body-side and the second connector at the door-side, wherein the insulating member is inserted into the first female terminal when the first and second connectors engage with each other, so that an electric circuit is cut.

With the construction described above, since the first female terminal forming a break contact (b-contact) is provided in one connector selected between the first connector at a vehicle body-side and the second connector at a door-side, the first female terminal forms a close circuit when the first and second connectors do not engage with each other, thereby supplying a power to an electric component such as a courtesy lamp, while the insulating member is inserted into the female terminal so as to cut the electric circuit when the first and second connectors engage with each other. That is, by the engagement or disengagement of both first and second connectors, a switching of the courtesy lamp cooperating with the open/close action of the door can be carried out, thereby both connectors can carry out a similar function as that of a courtesy lamp switch. Therefore, a space for mounting the electric components can be secured by omitting the courtesy lamp switch and the cost of the electric component can be reduced by making the connector have multifunction.

Preferably, the connector structure of a motor vehicle door further comprises:

a second female terminal forming a make contact, which is provided next to the first female terminal; and a male terminal forming a break terminal coming in contact with the second female terminal, which is provided next to the insulating member.

With the construction described above, since a plurality of male terminals facing with a plurality of second female terminals that forms a make contact (a-contact) are provided, the male terminal comes in contact with the second female terminal when both connectors engage with each other, thereby a closed electric circuit is formed and a power can be supplied from the vehicle body-side to the electric components at the door-side. The break contacts, the number of which is equal to that of the male terminals, can be formed. Therefore, a connection structure between the electric circuit at the vehicle body-side and that at the door-side can be integrated into the connector and the cost of the electric component can be reduced by making the connector have multifunction.

Preferably, the first female terminal includes a pair of contact members.

With the construction described above, by biasing one side end of the contact member using an elastic member or the like, a female terminal that can be opened or closed is formed, thereby the insulation member is allowed to enter into the female terminal when both connectors engage with each other so as to cut the electric circuit.

Therefore, a return-type switch having a break contact can be integrally formed in the connector, thereby a space for mounting the electric components can be secured by omitting a switch at the vehicle body-side.

Preferably, a first contact coming in contact with the insulating member is provided at one side of each of the pair of contact members while a second contact coming in contact with an electrode that continues to the electric circuit is provided at the other side, and each said first contact comes in contact with the other first contact receiving an inward bias by an elastic member while each said second contact is pressed onto the electrode receiving an outward bias by the elastic member.

With the construction described above, each first contact can electrically comes in contact with the other first contact while each second contact can come in contact with the corresponding electrode, thereby a female terminal having a break contact can be formed.

Therefore, the reliability of the electric contact of the female terminal that forms a closed electric circuit can be improved.

Preferably, one contact member of the pair of contact members is connected to an electromagnetic coil forming an electromagnetic relay through the electrode while the other contact member is grounded to a motor vehicle body through the electrode.

With the construction described above, when the both connectors do not engage with each other, that is, when the door is open, the female terminal forms a closed electric circuit to allow the electric power to be conducted, thereby the power can be supplied to the electric component such as a courtesy lamp and so on.

On the other hand, when the door is closed, the female terminal forms an open circuit not to allow the electric power to be conducted.

Consequently, the female terminal having a break contact can function as a courtesy lamp switch and a space for mounting the electric components can be secured by omitting a conventional courtesy lamp switch.

Preferably, a projecting length of the insulating member is smaller than that of the male terminal.

With the construction described above, even when the first connector at the vehicle body-side and the second connector at the door-side halfway engage with each other, that is, even when the door is incompletely closed, the closed electric circuit by the female terminal is not cut by the insulating member, thereby the detection of an incomplete door-closing can be carried out.

Therefore, the connector that has a function as a courtesy lamp switch can also has a function to detect the halfway opened door.

DESCRIPTION OF THE PREFERRED EMBODIMENTS

In the following, the preferred embodiments of the present invention will be explained with reference to the attached drawings.

Figure 1:
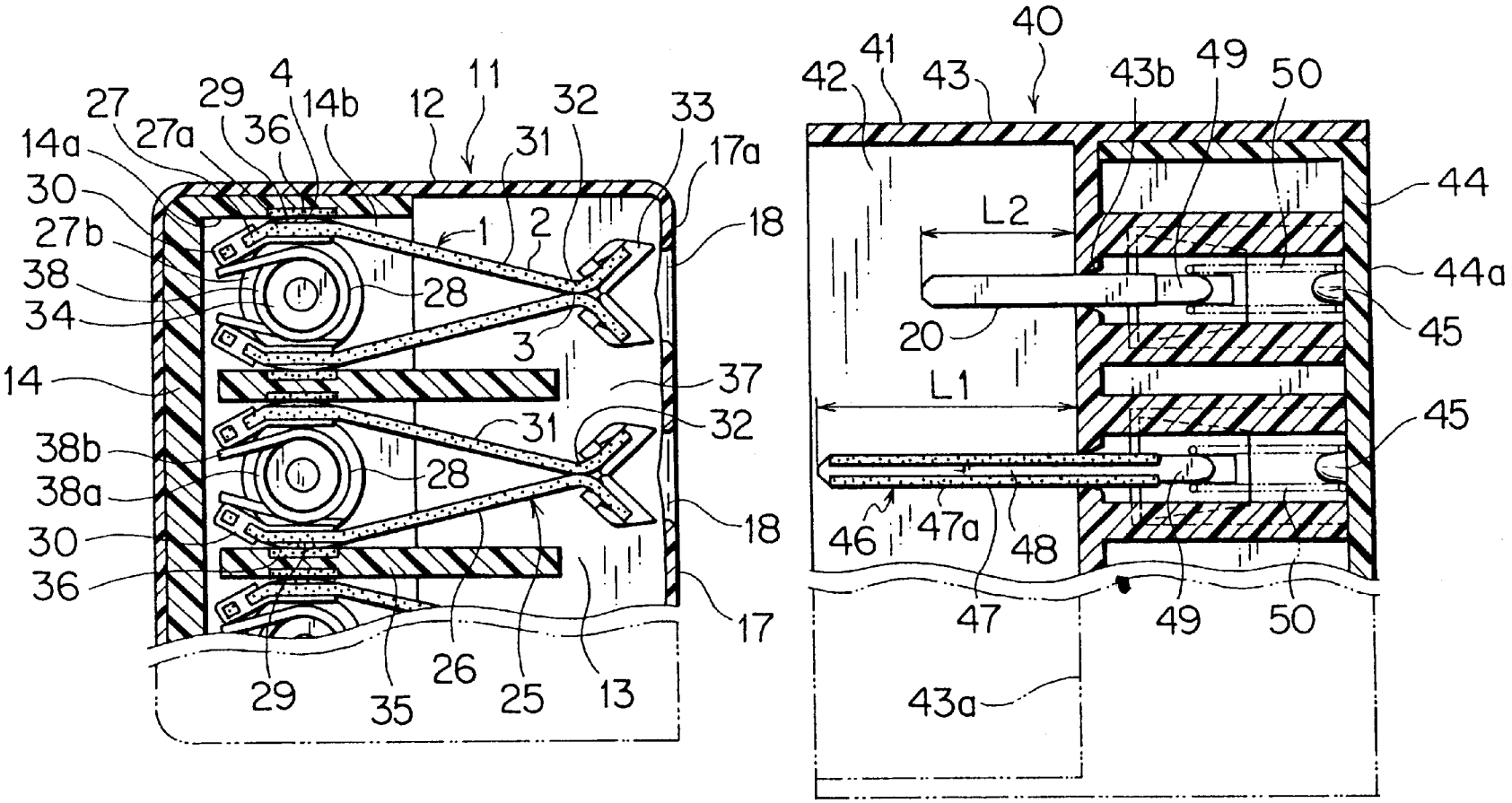
FIG. 1 is a cross sectional view illustrating a primary part of a connector structure of a motor vehicle door according to a preferred embodiment of the present invention.
Figure 2:
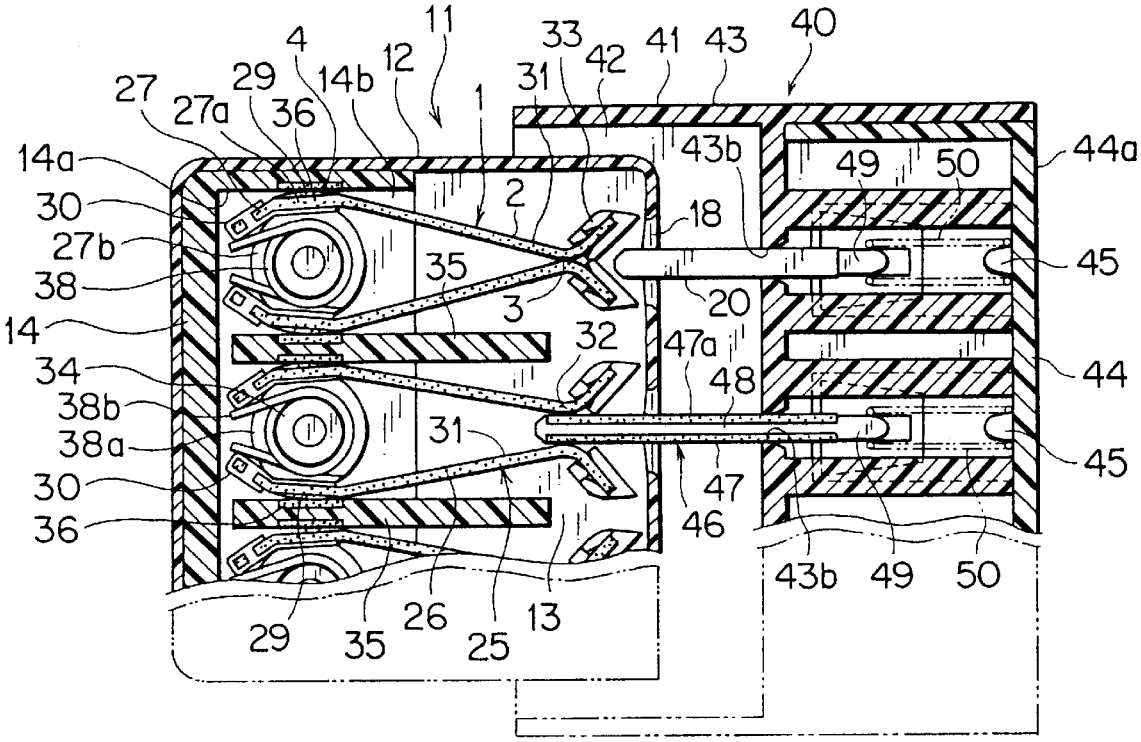
FIG. 2 is a cross sectional view illustrating a primary part of a connector structure of a motor vehicle door as shown in FIG. 1 in its halfway engaging state.
Figure 5:
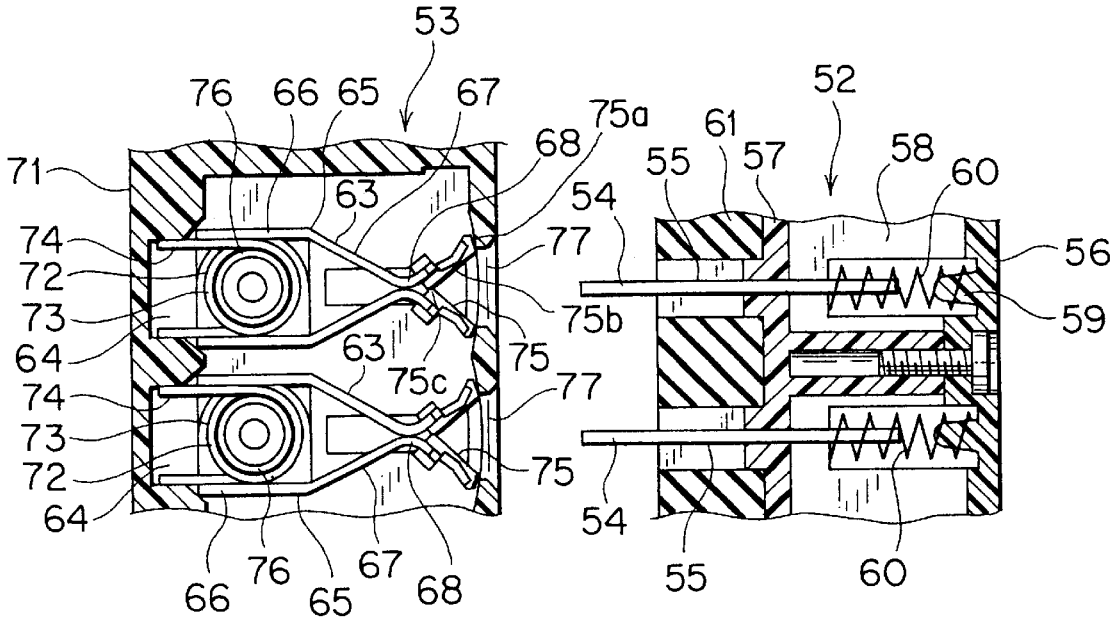
FIG. 5 PRIOR ART
FIG. 5 is a cross sectional view illustrating a primary part of a conventional connector structure of a motor vehicle door.

FIG. 1 is a cross sectional view illustrating a primary part of a connector structure of a motor vehicle door according to a preferred embodiment of the present invention. FIG. 2 is a cross sectional view illustrating a primary part of a connector structure of a motor vehicle door as shown in FIG. 1 in its halfway engaging state.

The connector structure of a motor vehicle door is for supplying an electric power to various auxiliary machines or electric components in a door such as a rear wiper, door lock, tail lamp, defroster and power window. The connector structure includes a connector 11 at the vehicle body-side and a connector 40 at the door-side and applied to a rear door of a station wagon and a sliding door of a one-box car.

Here, a front-and-rear direction, right-and-left direction, and up-and-down direction are defined as follows. The front-and-rear direction is defined as a direction, in which both connectors 11, 40 engage with each other. The front side of each connector is defined as the side, from which the connector faces with the mating connector. The right-and-left direction (i.e. horizontal direction) of each connector is defined as the direction, in which the pair of contact members 2 opens or closes. Both connectors have bilateral symmetry. The up-and-down direction is defined as the direction, in which the contact member 2 is inserted into a cylinder shaft 34. The down side is defined as the side, on which the contact member 2 is placed relatively to a bottom wall 14*b* of a case 14.

As shown in FIG. 1, the connector 11 at the vehicle body-side includes a box-shaped housing 12 having an inner space 13, a female terminal 1 forming a break contact, and at least one female terminal 25 forming a make contact.

The housing 12 includes a case 14 on which the female terminals 1, 25 are placed and a cover 17 for covering the case 14. A front wall surface 17*a* of the cover 17 has each opening 18 in parallel for inserting an insulating member 20 and male terminal 46 (explained later on). The female terminal 1 or 25 is inserted into the inside of each opening 18. The opening 18 is closed by a shutter 33 (explained later on) to prevent an electrically conductive contamination, water drop or dust from entering thereinto.

The female terminal 1 forming a break contact has a pair of contact members 2 and is arranged facing an insulation member 20 of the connector 40 at the door-side. Each contact member 2 is made from a thin flat plate by cutting and bending it to have a S-shape or inverse S-shape as shown in FIG. 1. Each contact member 2 is supported by a cylinder shaft 34 so as to be able to oscillate and biased to the right-and left direction by a twisted coil spring (elastic member) 38, which is inserted over the cylinder shaft 34.

Along the direction, in which both connectors 11, 40 engage with each other, each contact member 2 includes a part 27 for receiving the bias by the twisted coil spring 38, a contact 4 coming in contact with an electrode, an inclined plate 31 which continues from the contact 4 and extends forward, and a contact 3 which continues from the inclines plate 31 and bends outward.

Figure 6:
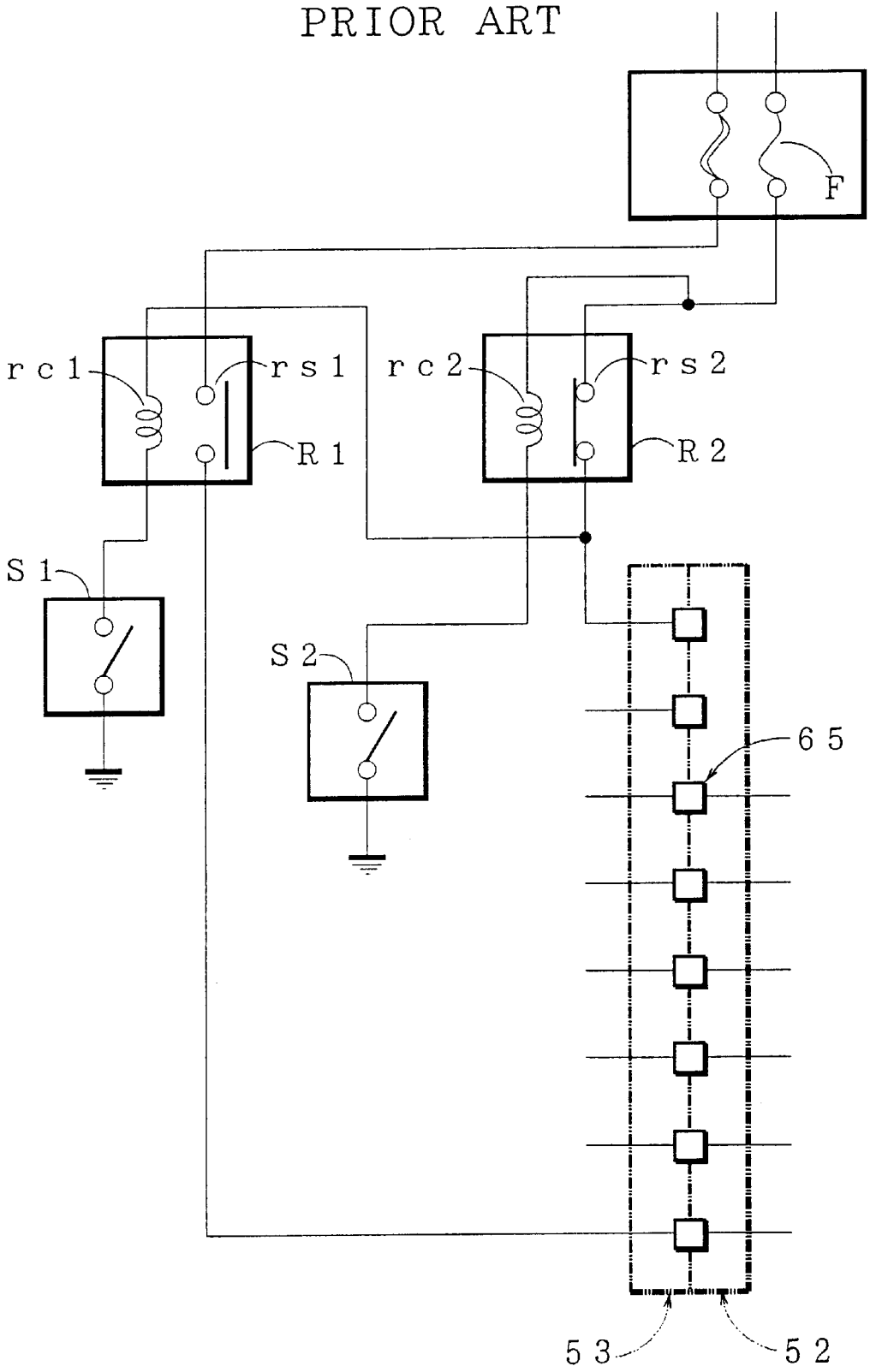
FIG. 6 PRIOR ART
FIG. 6 is a circuit view illustrating an engaging state of a connector in a conventional connector structure of a motor vehicle door.

Each contact 3 comes in contact with the other contact 3 with receiving the inward bias from the twisted coil spring 38. The pair of contacts 3 forms a break contact by coming in contact with each other under a moderate pressure when both connectors 11, 40 do not engage with each other. Thus, when the contact 3 is closed, an electrical conduction state is attained and a courtesy lamp (not shown) is turned on. To the contrary, when both connectors 11, 40 engage with each other, the contact 3 is opened, thereby a non-electrical conduction state is attained and a courtesy lamp (not shown) is turned off. That is, the contact 3 has a similar function to that of the switch (courtesy lamp switch) S2 as shown in FIG. 6 of the prior art.

The inclined plate 31 connects the part 27 for receiving the bias to the contact 3 and is inclined inward as advancing forward. A locking step (not shown) is formed at the lower end of the inclined plate 31 so that the contact 2 is prevented from shifting when the insulating member 20 of the connector 40 at the door-side is inserted into the female terminal 1.

The part 27 for receiving the bias has a L-shape or inverse L-shape in its cross sectional view and includes a side plate 27*a* and a bottom plate 27*b* which continues from the lower end of the side plate 27*a* and bends perpendicularly inward. The side plate 27*a* and bottom plate 27*b* is coated with an adherent insulating material 30 so as to prevent an electrical contact, which may happen when each side plate 27*a* approaches the other side plate 27*a* or when the bottom plate 27*b* approaches the other bottom plate 27*b*, from occurring.

The contact member 2 is mounted by using a shaft hole 28 which is formed at the center of the bottom plate 27*b*. That is, the shaft hole 28 is inserted over the cylinder shaft 34, which engages with a boss (not shown) of a case 14, so as to be able to oscillate, and a boss (not shown) of a cover 17 engages with the cylinder shaft 34 so as to fix each contact member 2.

The twisted coil spring 38 is provided on the bottom plate 27*b* with aligning its axial direction (i.e. expansion-and contraction direction) with the up-and-down direction. The twisted coil spring 38 is fixed by combining the case 14 and cover 17 up and down and bolting with a bolt (not shown).

A coil roll 38*a* of the twisted coil spring 38 presses the bottom plate 27*b* downward, thereby each contact member 2 can be mounted without a back-lash. The elastic force (i.e. pressing force) thereof is set so that the horizontal oscillation of each contact member 2 can be smoothly carried out.

A pair of legs 38*b* of the twisted coil spring 38 biases the side plate 27*a* of the part 27 for receiving the bias outward in the right-and-left direction, thereby the contact 4 coming in contact with the electrode, which continues from the side plate 27*a*, abuts against an electrode 36 buried in a partition wall 35 so as to be electrically connected to the electrode 36.

The contact 4, which continues from the side plate 27*a*, is formed having a smoothly bulged-shape, thereby the contact between the contact 4 and the electrode 36 is always maintained even when each contact 3 oscillates.

Figure 3:
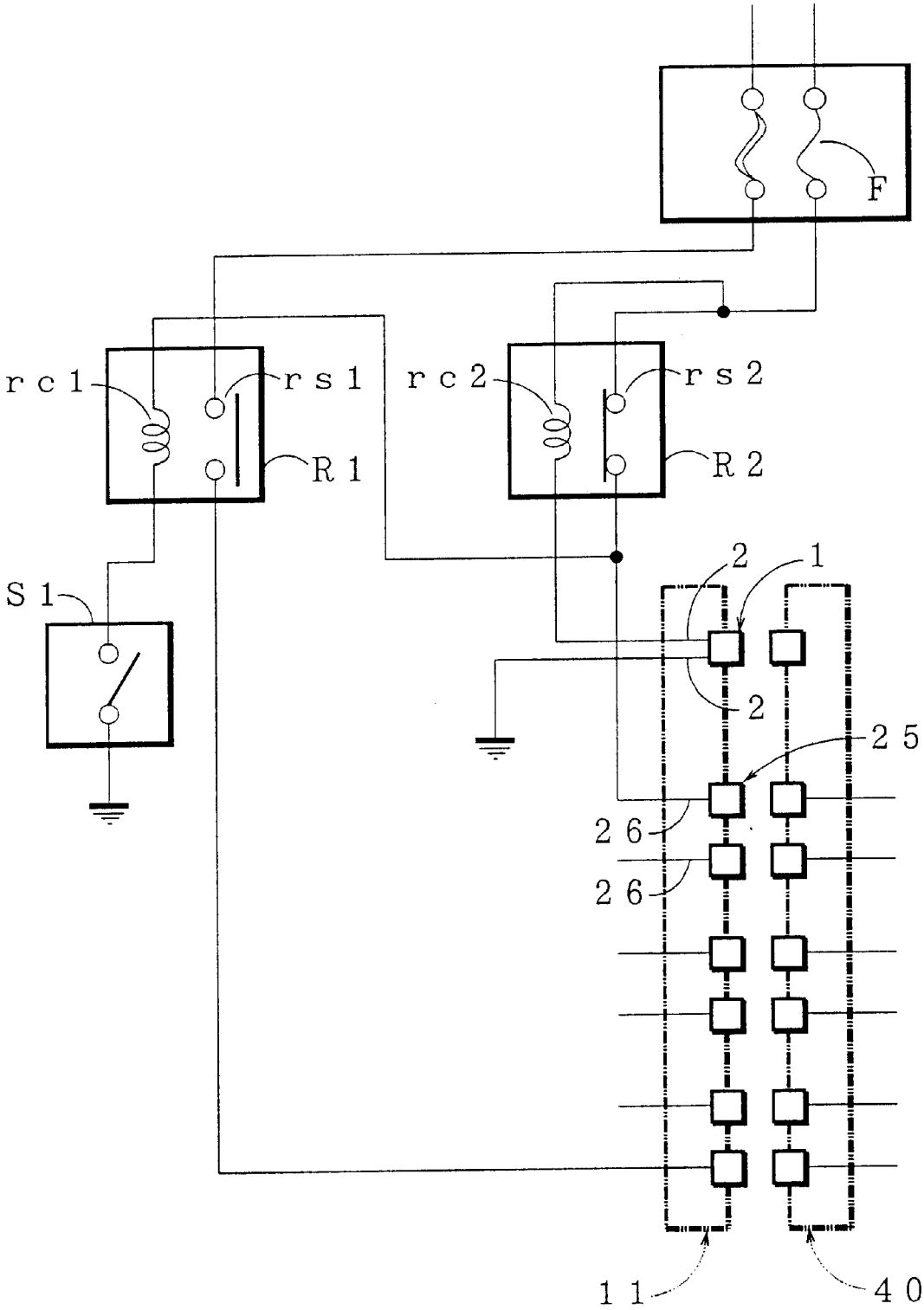
FIG. 3 is a circuit view illustrating a non-engaging state of a connector in a connector structure of a motor vehicle door.
Figure 4:
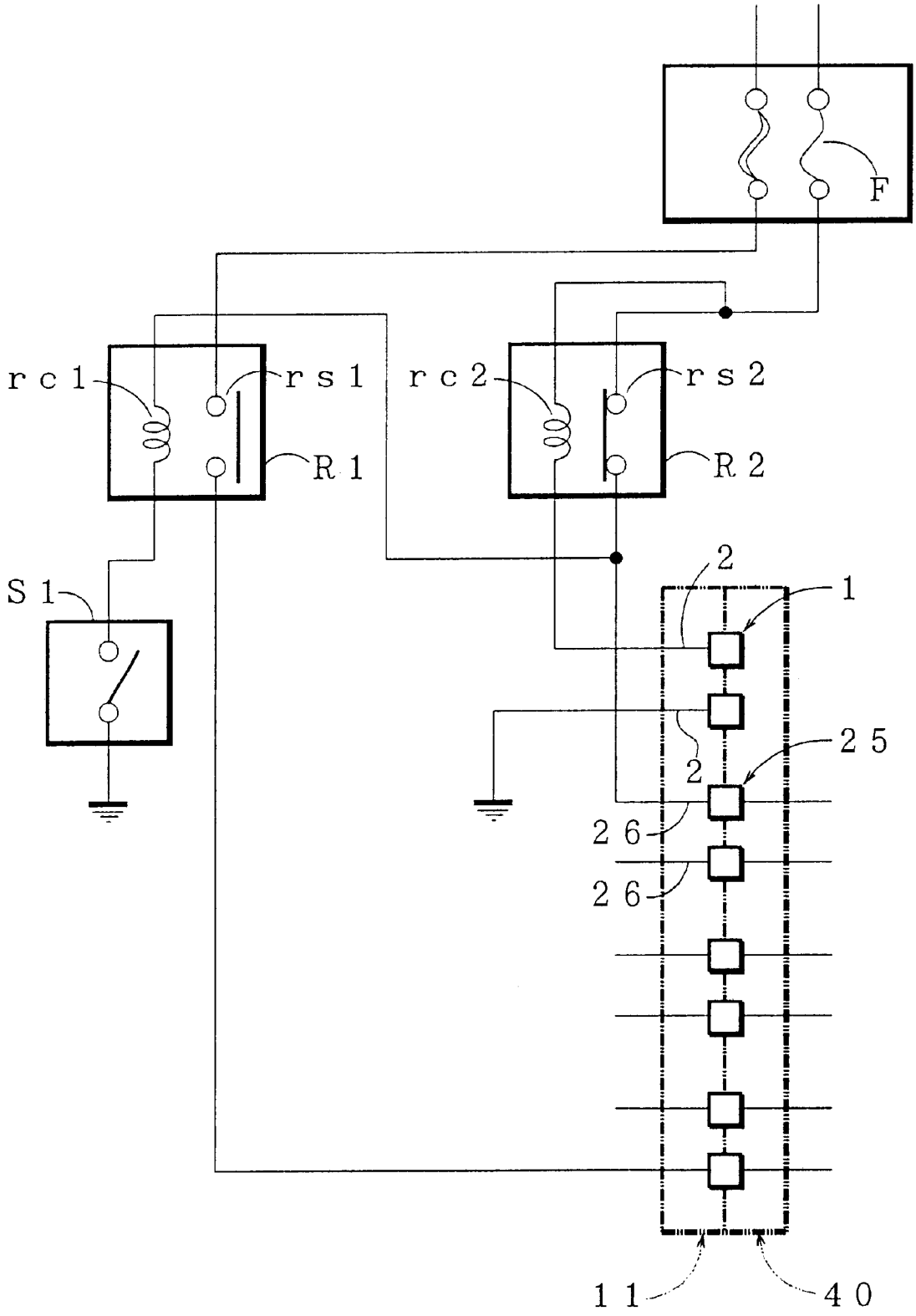
FIG. 4 is a circuit view illustrating an engaging state of a connector in a connector structure of a motor vehicle door.

As shown in FIGS. 3 and 4, one of the pair of contact members 2 that forms the female terminal 1 is connected to an electromagnetic coil rc2 of an electromagnetic relay R2 through the electrode 36, while the other of the pair of contact members 2 is grounded to the motor vehicle body through the electrode 36. Consequently, when both connectors do not engage with each other (see FIG. 3), the female terminal 1 is in the electrical conduction state and the courtesy lamp (not shown) is turned on with receiving the electric power from a battery. To the contrary, when both connectors engage with each other (see FIG. 4), the female terminal 1 is in the non-electrical conduction state and the courtesy lamp is turned off since the electric circuit is cut.

The electrode 36 is buried in the partition wall 35 and the side wall 14*a* of the case 14, which functions as the partition wall 35, and situated facing with the contact 4 of each contact member 2. The electrode 36 is formed by integral molding or press fitting by using an electrically conductive metal material such as copper plate or electrically conductive synthetic resin. One electrode 36 is connected to an electric circuit of the courtesy lamp while the other electrode 36 is connected to an electric circuit of ground.

A plurality of female terminals 25 forming a make contact are arranged in parallel to the female terminal 1. The female terminal 25 has a similar structure to that of the female terminal 1. Each contact member 26 of a pair of contact members 26 functions as a contact terminal, which is independent from the other contact terminal, and is connected to a conductor 47*a* at one side of a male terminal 46 (explained later on), thereby the electric circuit of the vehicle body-side is connected to that of the door-side.

That is, the pair of contact members 2 of the female terminal 1 forms a break contact and the contact is opened to form an open circuit when both connector engage with each other. On the other hand, as shown in FIGS. 3 and 4, the pair of contact members 26 of the female terminal 25 forms a make contact and the contact is closed to form a closed circuit when both connector engage with each other.

As shown in FIGS. 1 and 2, the connector 40 at the door-side includes a box-shaped housing 41 having an opening space 42 at the end thereof, an insulating member 20 to be received in an interior space of the housing 41, and a plurality of male terminals 46.

The housing 41 includes a case 43 facing with the mating connector 11 at the vehicle body-side and a cover 44, which is situated at the rear of the case 43 and inserted into the inside of the case 43. The cover 44 and case 43 may be separately formed or integrally formed with each other. The cover 44 and case 43 are made of insulating synthetic resin.

The opening space 42 of the case 43 is provided with a cushion (not shown) made of urethane rubber or the like for absorbing the impact relatively to the connector 11 at the vehicle body-side. The cushion has an insertion hole 43*b*, through which the insulating member 20 and the male terminal 46 pass. The insulating member 20 and male terminal 46 protrude from the insertion hole 43*b* so as to come in contact with the female terminals 1, 25 of the connector 11 at the vehicle body-side, respectively.

With the aid of the cushion, the impact arisen when the connector 11 comes in contact with the connector 40 (i.e. when the door is closed) is absorbed, thereby the insulating member 20 and male terminal 46 can be securely inserted without being bent or damaged. The insulating member 20 is made of hard synthetic resin material.

The rear side of the insulating member 20 is elastically supported by a coil spring 50, which has a cylinder shape and can be compressed in the axis direction thereof. The insulating member 20 is strongly biased in the direction of insertion and can move back when accidentally interfered from the outside. The strength of the coil spring 50 is set larger than the insertion force of the insulating member 20 into the pair of contact members 2, so that the insulating member 20 can be smoothly inserted between the contacts 3 of the pair of contact members 2. By the coil spring 50 and the cushion, the insulating member 20 is doubly protected from the interference with the outside.

As shown in FIG. 1, a projecting length L2 of the insulating member 20 is set smaller than a projecting length L1 of the male terminal 46 in order that the female terminal 1 can form a closed circuit so as to turn on the courtesy lamp even when the door of the vehicle is not completely closed, that is, in order to add the function of detecting an incomplete door-closing to the connector structure of the present invention.

A plurality of male terminals 46 are arranged in parallel to the insulating member 20, each of which has a tab-shaped electrical contact 47 at the end side and a spring mount 49 at the base side.

The electrical contact 47 of the male terminal 46 includes a conductor 47*a* at both sides of the width direction (horizontal direction) and a straight insulator 48 situated between both conductors 47*a*. The insulator 48 made of synthetic resin such as plastic is integrally formed with the conductor 47*a* by insert molding. The insulator 48 tightly adheres to the conductor 47*a* so that the junction thereof is not damaged even when the male terminal 46 is repeatedly inserted in the female terminal 25.

The conductor 47*a* is provided at both sides of the insulator 48 and the end of the conductor 47*a* is covered with the insulator 48, thereby each conductor 47*a* does not come in contact with the other conductor 47*a*, that is, each conductor 47*a* functions as an independent contact terminal.

The base-side of the male terminal 46 is provided with a junction (not shown) for supplying an electric power to the electric components in the door. A terminal (not shown) having a wire is connected to the junction by screwing or the like.

A male terminal integrally formed with an electrically conductive board may be used instead of the male terminal 46 having the conductor 47*a* at both sides thereof. A female terminal of monopole may be used instead of the female terminal 25 of double pole that forms a make contact.

The aforementioned preferred embodiments are described to aid in understanding the present invention and variations may be made by one skilled in the art without departing from the spirit and scope of the present invention.

What is claimed is:

1. A connector structure of a motor vehicle door comprising:

a first female terminal forming a break contact, which is provided in one connector selected between a first connector at a vehicle body-side and a second connector at a door-side; and an insulating member, which is provided in the other connector selected between the first connector at the vehicle body-side and the second connector at the door-side, wherein the insulating member is inserted into the first female terminal when the first and second connectors engage with each other, so that an electric circuit is cut.

2. The connector structure of a motor vehicle door according to claim 1, further comprising:

a second female terminal forming a make contact, which is provided next to the first female terminal; and a male terminal forming a break terminal coming in contact with the second female terminal, which is provided next to the insulating member.

3. The connector structure of a motor vehicle door according to claim 1 or 2, wherein the first female terminal includes a pair of contact members.

4. The connector structure of a motor vehicle door according to claim 3, wherein a first contact coming in contact with the insulating member is provided at one side of each of the pair of contact members while a second contact coming in contact with an electrode that continues to the electric circuit is provided at the other side, and each said first contact comes in contact with the corresponding second contact and receives an inward bias by an elastic member while each said second contact is pressed onto the electrode receiving an outward bias by the elastic member.

5. The connector structure of a motor vehicle door according to claim 3, wherein one contact member of the pair of contact members is connected to an electromagnetic coil forming an electromagnetic relay through the electrode while the other contact member is grounded to a motor vehicle body through the electrode.

6. The connector structure of a motor vehicle door according to claim 2, wherein a projecting length of the insulating member is smaller than that of the male terminal.

* * * * *